United States Patent [19]

Roberts et al.

[11] Patent Number: 4,703,975

[45] Date of Patent: Nov. 3, 1987

[54] BIRTHING CHAIR

[76] Inventors: Phoebe Roberts; James M. Roberts, both of Rte. 1, Box 605, Denton, N.C. 27239

[21] Appl. No.: 891,020

[22] Filed: Jul. 31, 1986

[51] Int. Cl.[4] ..... A47C 7/50

[52] U.S. Cl. ..... 297/429; 297/183; 297/430; 297/431

[58] Field of Search ..... 297/429, 430, 431, 183; 5/431, 436, 448, 441, 449

[56] References Cited

U.S. PATENT DOCUMENTS

| | | | |
|---|---|---|---|
| 49,132 | 8/1865 | McIlroy | 297/429 X |
| 1,025,819 | 5/1912 | Mackneer | 297/429 X |
| 1,125,167 | 1/1915 | Pepper | 297/429 X |
| 1,622,313 | 3/1921 | Gellhorn | 297/423 X |
| 2,499,884 | 3/1950 | Singleton | 297/429 |
| 2,591,911 | 4/1952 | Block | 297/464 |
| 3,151,910 | 10/1964 | Larson | 297/430 X |
| 3,516,709 | 6/1970 | Nader | 297/183 X |
| 4,383,713 | 5/1983 | Roston | 5/431 X |

*Primary Examiner*—James T. McCall

*Attorney, Agent, or Firm*—Griffin, Branigan, & Butler

[57] ABSTRACT

A birthing chair (10) for a pregnant woman to deliver her child. The birthing chair (10) comprises an essentially horizontal seat portion (12) having a backrest (14), the seat portion (12) being supported by a plurality of legs (22,23). An essentially planar work surface (16), having a footrest (38) is selectively connected to the birthing chair (10) between the legs (22,23).

13 Claims, 5 Drawing Figures

BIRTHING CHAIR

BACKGROUND OF THE INVENTION

When a mother-to-be goes to a hospital or clinic to give birth, she is typically placed in a lying down position. Such a position requires the mother-to-be to deliver her child against the pull of gravity, resulting in more strenuous labor. Additionally, the lying-down position increases the strain placed on the mother's back during the pushing phase of the delivery.

An object of the present invention is to provide a birthing chair in which the delivery of a child occurs with the assistance of gravity.

An advantage of the present invention is the provision of an angled backrest on a birthing chair which allows the mother to push back on the backrest during certain phases of the delivery and at the other times to comfortably rest against the backrest.

Another advantage of the present invention is the provision of a birthing chair having means for selectively changing the distance of a foot rest from a front edge of a chair.

Yet another advantage of the present invention is the provision of a footrest which is selectively and slidably mounted with respect to a work surface.

Yet another advantage of the present invention is the provision of a horizontally attached handgrip to each opposing side of the birthing chair.

SUMMARY

A birthing chair for a pregnant woman to deliver her child. The birthing chair comprises an essentially horizontal seat portion having a backrest, the seat portion being supported by a plurality of legs. An essentially planar work surface, having a footrest is selectively connected to the birthing chair between the legs.

DETAILED DESCRIPTION OF THE DRAWINGS

Referring to FIGS. 1–5, a birthing chair 10 comprises an essentially horizontal seat portion 12, a backrest 14 and a planar work surface 16. The birthing chair 10 is manufactured from any suitable material, such as wood.

Figure 1:
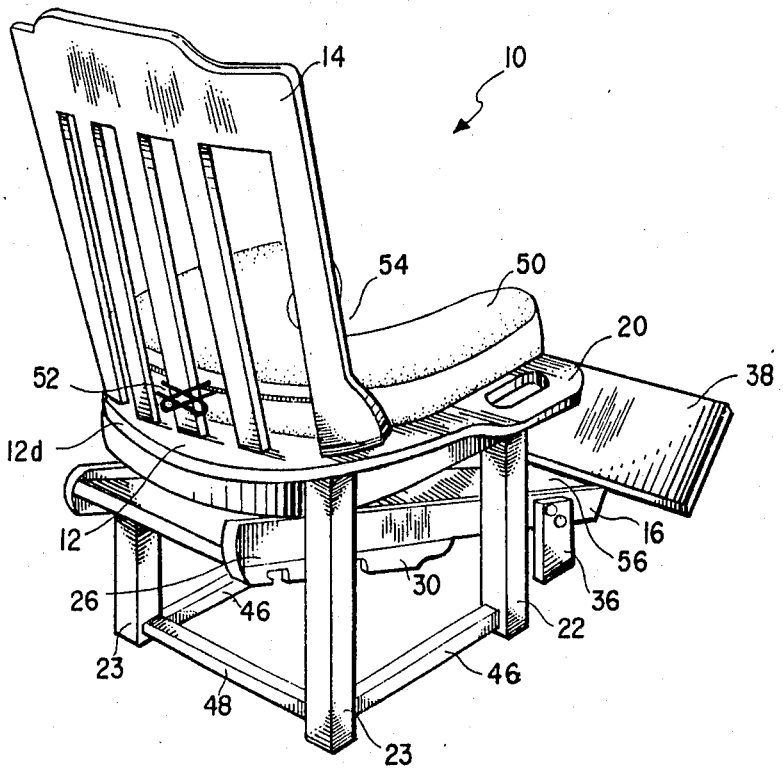
FIG. 1 is a rear perspective view of a birthing chair according to an embodiment of the invention.
Figure 2:
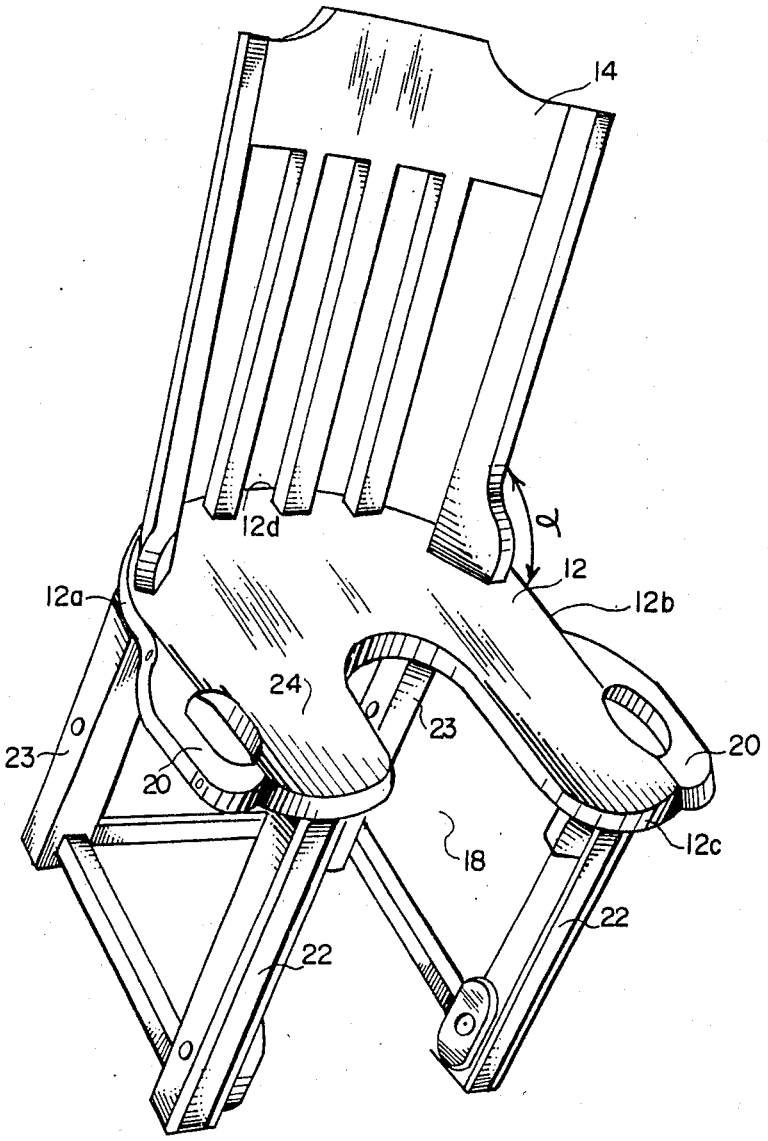
FIG. 2 is a front perspective view of the embodiment of FIG. 1 with a work surface removed.
Figure 3:
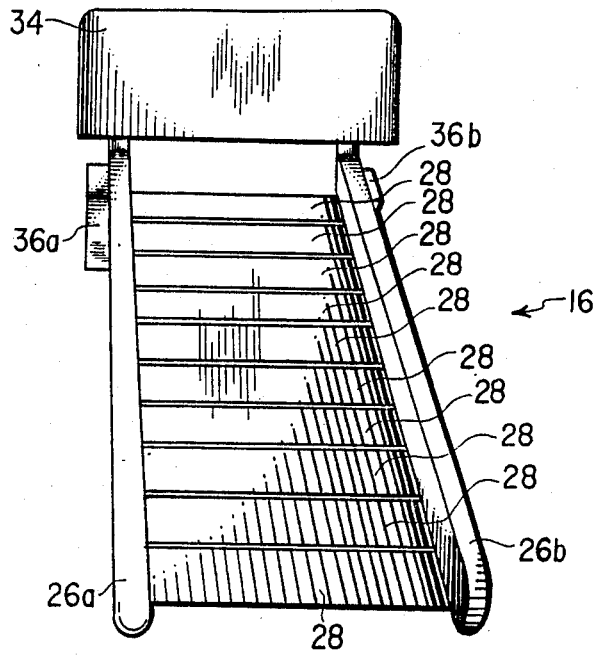
FIG. 3 is a top view of the work surface used with the embodiment of FIG. 1.

Seat portion 12 (FIG. 2) comprises an essentially horizontal surface having a width defined from a first side edge 12*a* to a second side edge 12*b*, and a depth defined from a front edge 12*c* to a back edge 12*d*. An essentially U-shaped opening 18 extends from the front edge 12*c* approximately mid-way between the first side edge 12*a* and second side edge 12*b* Handgrips 20 are attached to each side edge 12*a* and 12*b* proximate the front edge 12*c* using screws or other suitable securing means. As shown in FIG. 2, the furtherest extent of the U-shaped opening 18 is closer to the backrest 14 than are the handgrips 20. The seat portion 12 is raised a predetermined distance above the ground by a pair of front legs 22 and a pair of rear legs 23. Each leg is placed proximate the joining of two edges of the seat portion 12 (i.e., a side edge and a back edge). Leg connecting means, such as a rod 24, is secured to the rear legs 23 at a point intermediate the length of the rear legs 23 for selectively connecting the work surface 16, to be discussed below, to the seat 12. For additional stability of the chair 10, a series of leg braces are secured to the legs 22 and 23 proximate a portion of the leg nearest the ground. Braces 46 connect one front leg 22 to one rear leg 23. Brace 48 connects the two rear legs 23 together.

Backrest 14 is constructed of several slats connected together as shown in the drawings. Alternatively, the backrest 14 may be made from a solid piece of material. The width of the backrest 14 (which has a slight curvature to conform to the mother's back) is chosen to complement the width of the seat portion 12. The height of the backrest 14 is chosen so as to be comfortable for a typical woman. The backrest 14 is attached with screws or other suitable means to the seat portion 12 proximate the back edge 12*d* at an angle alpha relative to the seat portion 12. Angle alpha is preferably slightly greater than 90 degrees, resulting in a slight backward tilt.

Planar work surface 16 (FIGS. 3 and 4) comprises two frame members 26*a* and 26*b* spaced apart a predetermined distance by a plurality of slats 28 which form a substantially continuous work surface. A pair of engaging means, such as slotted members 30*a* and 30*b* having a plurality of notches 31, are attached to the underneath of the frame members 26*a* and 26*b* of the work surface 16 proximate a first end 27*a* and 27*b* of the respective frame members. The notches 31*a* and 31*b* in the engaging means 30 are adapted to engage the rod 24 connected to the rear legs 23 of the birthing chair 10.

Figure 4:
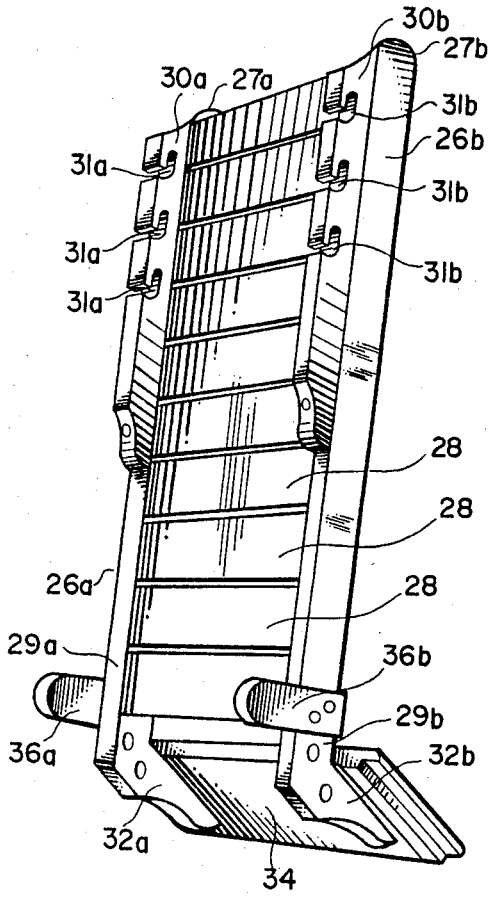
FIG. 4 is a bottom view of the work surface of FIG. 3.
Figure 5:
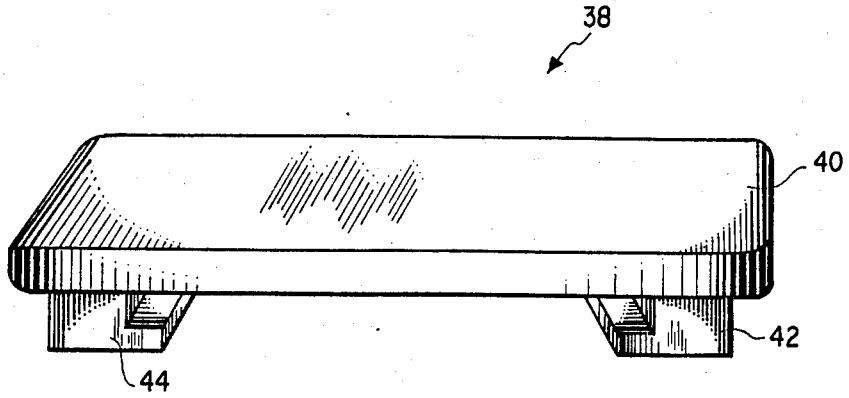
FIG. 5 is a view of a footrest used with the work surface of FIG. 3.

A bracket 32*a* is attached to a second end 29*a* of the frame member 26*a* at an approximate angle of 90 degrees as shown in FIG. 4. In a similar fashion, bracket 32*b* is attached to a second end 29*b* of the second frame member 26*b*. A substantially flat rectangular surface member 34 is secured to the top edges of the brackets 32*a* and 32*b* for accepting a footrest 38, to be described below. A first support or foot 36*a* extends downwardly from the frame member 26*a* proximate the second end 29*a* while a second supportor foot 36*b* extends downwardly from the frame member 26*b* proximate the second end 29*b*. The supports 36 function to raise the second end 29 of the work surface 16 a predetermined distance above the ground.

The footrest 38 (FIG. 5) comprises a substantially rectangular shaped level surface 40 having a pair of slidable engaging means or angle brackets 42 and 44 secured to its bottom surface. The footrest 38 is designed to engage and slide over the flat surface member 34 on the work surface 16. Accordingly, the two angle brackets 42 and 44 are spaced apart a distance slightly greater than the width of the flat surface member 34.

Preparing the birthing chair for use involves placing a padded leather cushion 50 on the seat portion 12 and securing it to the backrest 14 with a tiedown 52. The cushion 50 has an opening 54 therein which replicates complement the U-shaped opening 18 in the seat portion 12. A lip (not shown) is provided in the cushion 50 so that fluids may run off the cushion 50.

The work surface 16 is secured to the seat portion 12 by placing one of the notches 31 in the slotted member 30 over the rod 24. A rectangular shaped removable leather pad 56 is then placed on the work surface 16 so that one end of the pad 56 abutts the flat surface member 34. The footrest 38 is slid over the flat surface member 34, trapping the pad 56 between an edge of the footrest 38 and the work surface 16.

A woman ready to give birth is seated in the birthing chair 10. She places her legs in an arched position (typically called a "birthing position") above the work surface 16 so that her feet can push against the footrest 38 while her thighs and legs are suspended above the work surface. If necessary to make the mother-to-be more comfortable the position of the footrest 38 relative to the front edge 12*c* of the chair 10 is adjusted by using a different one of the the notches 31 on the slotted members 30 to engage the rod 24. During the delivery, the mother-to-be pushes upon the footrest 38. She also pulls upon the handgrips 20 while pushing back into the backrest 14. The angled backrest 14 allows the mother-to-be to comfortably rest during certain phases of her delivery and efficiently push into the back of the backrest 14 during other phases. During the rest phase of the delivery, the work surface 16 may be temporarily repositioned if desired so that the mother-to-be can rest her thighs and legs on the work surface 16. A pan can be placed on the work surface 16 to catch fluids that run off the cushion 50. Additionally, the newly-born infant can be placed on the leather pad 56 while a doctor or midwife attends to the infant's needs. Afterwards, the cushion 50 and pad 56 are removed and cleaned.

While the invention has been particularly shown and described with reference to the preferred embodiment thereof, it will be understood by those skilled in the art that various alterations in form and detail may be made therein without departing from the spirit and scope of the invention.

We claim:

1. A birthing chair comprising:

(a) an essentially horizontal seat portion having a width from a first side edge to a second side edge, and a depth from a front edge to a back edge, said horizontal seat portion having an essentially U-shaped opening extending from said front edge;

(b) a backrest attached to said seat portion proximate said back edge;

(c) a plurality of legs supporting said seat portion, including at least one leg on said first side edge and a second leg on said second side edge;

(d) a handgrip attached to each of said opposing side edges of said seat portion;

(e) an essentially planar work surface extending at least partially between said first and second legs, said planar work surface having a first end and an opposing second end, said planar work surface means proximate a first end thereof to connect said planar work surface to said first and second legs, said planar work surface being positioned below said horizontal seat portion and being suitable to rest thereon a newly born baby;

(f) a footrest mountable on said second end of said planar work surface, said footrest being mounted substantially perpendicular to said planar work surface; and, (g) means for connecting said first end of said planar work surface to said first and second legs in a manner whereby the distance of said footrest from said front edge of said seat portion is selectively changeable.

2. A birthing chair as recited in claim 1, wherein said backrest is attached to said seat portion at an angle that maximizes the pushing effort upon said backrest by a woman delivering a baby during certain phases of the delivery and is also comfortable to rest against during other phases of the delivery.

3. A birthing chair as recited in claim 1, wherein said selective connecting means comprises a rod that is connectable to an engaging means on said planar work surface, one end of said rod being secured to said first leg and the remaining end of said rod being secured to said second leg, said rod being secured to said legs at a point intermediate the length of said legs.

4. A birthing chair as recited in claim 3, wherein said engaging means for connecting said planar work surface to said first and second legs comprises a slotted member, said slotted member having a plurality of notches for engaging to said rod.

5. A birthing chair as recited in claim 1 further comprising:

a seat cushion positioned on said seat portion, said seat cushion having a shape matching the circumferential outline of said seat portion; and, a substantially rectangular shaped pad positioned on said planar work surface, one end of said pad being positioned proximate said second end of said planar work surface

6. A birthing chair as recited in claim 5, wherein said seat cushion includes means for retaining said cushion on said seat portion.

7. A birthing chair as recited in claim 6, wherein said retaining means comprises a tiedown on said cushion, said tiedown being tied to said backrest.

8. A birthing chair as recited in claim 1, wherein said birthing chair has four legs, one leg being attached proximate each outer corner of said seat portion.

9. A birthing chair as recited in claim 8, further including a plurality of braces attached to said legs for increasing the stability of said birthing chair.

10. A birthing chair as recited in claim 1, wherein said footrest is selectively and slidably mountable on said second end of said planar work surface.

11. A birthing chair as recited in claim 1, wherein said first end of said planar work surface is positionable at a distance further from said front edge of said horizontal seat portion than the distance at which said U-shaped opening extends from said front edge of said horizontal seat portion.

12. A birthing chair as recited in claim 1, wherein said planar work surface is essentially continuous from said first end to said second end thereof.

13. A birthing chair as recited in claim 1, wherein the furtherest extent of said U-shaped opening from said front edge of said seat portion is closer to said backrest than is said handgrip.

* * * * *